US006144829A

United States Patent [19]

Miyasaka et al.

[11] Patent Number: 6,144,829

[45] Date of Patent: Nov. 7, 2000

[54] DEVELOPING DEVICE AND ELECTROPHOTOGRAPHIC DEVICE

[75] Inventors: Toru Miyasaka; Kazushige Oonishi, both of Hitachi; Masahiko Saito, Kitaibaraki; Tadashi Okano, Hitachi; Shoji Takeya, Tokai-mura, all of Japan

[73] Assignee: Hitachi, Ltd., Tokyo, Japan

[21] Appl. No.: 09/297,520

[22] PCT Filed: Nov. 8, 1996

[86] PCT No.: PCT/JP96/03286

§ 371 Date: May 3, 1999

§ 102(e) Date: May 3, 1999

[87] PCT Pub. No.: WO98/21628

PCT Pub. Date: May 22, 1998

[51] Int. Cl.[7] ..... G03G 15/08

[52] U.S. Cl. ..... 399/281; 399/284

[58] Field of Search ..... 399/279, 281, 399/283, 284, 223, 236

[56] References Cited

U.S. PATENT DOCUMENTS

| | | | |
|---|---|---|---|
| 5,701,563 | 12/1997 | Fukida et al. | 399/284 |
| 5,722,021 | 2/1998 | Iwao | 399/284 |
| 5,815,775 | 9/1998 | Miyasaka et al. | 399/162 |

FOREIGN PATENT DOCUMENTS 6-95484 4/1994 Japan .

*Primary Examiner*—Joan Pendegrass
*Attorney, Agent, or Firm*—Antonelli, Terry, Stout & Kraus, LLP

[57] ABSTRACT

A developing device capable of high quality image recording by separating a toner supply chamber for supplying toner to a developing roll and a toner recovery chamber for recovering regulated toner by a regulating blade from each other by a sheet-shaped member thereby stabilizing the toner supply to the developing roll and the toner recovery.

16 Claims, 4 Drawing Sheets

DEVELOPING DEVICE AND ELECTROPHOTOGRAPHIC DEVICE

BACKGROUND OF THE INVENTION

The present invention relates to a developing device for use in an electrophotographic apparatus which is applicable for use with printers, facsimile apparatuses, copying machines, and the like.

The configuration of a known developing device is shown in FIG. 6. Referring to FIG. 6, reference numeral 1 denotes a developing roll for forming a thin layer of electrically charged tonor thereon and transporting the tonor to a photosensitive member; 2 denotes a transport roll for transporting the tonor to the developing roll 1; 3 denotes a tonor transporting vane for agitating the tonor and transporting the tonor to the transport roll; 5 denotes a regulating blade for regulating the amount of the tonor attaching onto the developing roll 1; 6 denotes a tonor storage for storing tonor; 9 denotes tonor; and 10 denotes a photosensitive member 10.

In a conventional developing device of the one-component type, the photosensitive member 10 is generally disposed so that at the tonor transfer position, it moves downward, and the developing roll 1, with a tonor thin layer formed thereon, is also arranged to rotate downward at the tonor transfer position facing the photosensitive member 10 to perform development.

The tonor 9 within the tonor storage 6 is transported to the transport roll 2 by the rotating tonor transporting vane 3. As the transport roll 2, a conductive or semiconductive foam roll is generally used. The tonor 9 transported to the transport roll 2 is further transported to the developing roll 1 by the rotating transport roll 2. The amount of tonor is regulated by the regulating blade 5 provided on the developing roll 1 and the tonor is electrically charged by friction with the regulating blade 5 to form a thin layer of charged tonor on the developing roll 1. The developing roll 1 with the charged tonor thin layer formed thereon, when brought into contact with or into the vicinity of the photosensitive member 10, develops an electrostatic latent image on the photosensitive member 10.

In the configuration of the developing device of FIG. 6, because the developing roll 1 is located below the regulating blade 5, tonor can be supplied in a stabilized manner to the regulating position of the regulating blade 5 located on the surface of the developing roll 1. Further, since the tonor which has become a surplus by the action of the regulating blade 5 can escape into the space above the regulating blade, a flow of tonor shown by an arrow 28 in the drawing is produced, and, thereby, the surplus tonor is returned, in a stabilized manner, to the transport roll 2 and the tonor storage 6 so as to be circulated. Thus, a stabilized tonor supply to the regulating blade 5 and the recovery of the surplus tonor can both be achieved, so that the tonor is prevented from stagnating or solidifying.

On the other hand, in the case of a developing device of a nonmagnetic one-component type in which the photosensitive member 10 is positioned to move upward at the tonor transfer position, it is necessary to cause the developing roll 1 with a tonor thin layer formed thereon also to rotate upward to perform development at the tonor transfer position facing the photosensitive member 10. Since, in this case, it is necessary to dispose the regulating blade 5 below the developing roll 1, it becomes difficult to supply the tonor to the regulating position of the regulating blade 5 on the surface of the developing roll 1 in a stabilized manner. Further, since the surplus tonor provided by the regulating blade 5 falls below the developing roll 1 due to gravity, it becomes difficult to form a circulating path as shown by the arrow 28 in FIG. 6 within the developing device.

A developing device for performing development using a developing roll 1 with a tonor thin layer formed thereon, which is rotated upward at the tonor transfer position facing the photosensitive member 10, is disclosed in the Japanese Patent Laid-open No. Hei 5-158345. The configuration of this developing device is shown in FIG. 7. Reference numerals used in FIG. 7 correspond to those in FIG. 6.

Referring to FIG. 7, there are formed a passage 29 for transporting tonor to the side of the developing roll 1 and a passage 30 for transporting the remaining tonor after the regulation by the blade has been made back to the tonor storage 6 so that the tonor 9 may be circulated. Further, there is disposed a transport roll 2 for assisting in the tonor supply to the regulating blade 5.

In addition to the above developing device, there is disclosed in the Japanese Patent Laid-open No. Hei 5-158331 a developing device in which the developing roll 1 performs development while rotating upward at the tonor transfer position facing the photosensitive member 10 and the regulating blade 5 is located above the developing roll 1. By such a configuration, it is intended to decrease the chances for the tonor to be repeatedly subjected to regulation by the regulating blade and to supply tonor of good quality for development to obtain a high quality image.

However, in the developing device disclosed in Japanese Patent Laid-open Publication No. Hei 5-158345, since the opening of the supply passage on the side of the developing roll is connected with the opening on the side of the return, recovery passage, namely, since the space on the side of the supply passage and the space on the side of the recovery passage are not completely separated from each other, it is difficult to simultaneously achieve a stabilized supply of the tonor to the vicinity of the regulating blade and a recovery of the surplus tonor regulated by the regulating blade. Therefore, in order to supply the tonor to the regulating blade 5 in a stabilized manner in the developing device disclosed in Japanese Patent Laid-open No. Hei 5-158345, it is required to maintain a stabilized tonor layer in contact with the surface of the transport roll under a certain amount of force and a space for allowing the tonor subjected to the regulation to flow out through it in a stabilized manner.

On the other hand, with the developing device disclosed in Japanese Patent Laid-open No. Hei 5-158331, since the passage for supplying the tonor to the regulating blade and that for recovering the tonor are required to be arranged above the developing roll, there is a disadvantage in that the overall developing device becomes greater in thickness and, therefore, larger in overall size.

In the developing device disclosed in the Japanese Patent Laid-Open No. Hei 5-158331, in which development is performed by rotating the developing roll with a tonor thin layer formed thereon upward at the tonor transfer position facing the photosensitive member to develop the surface of the photosensitive member, while it is moving upward, it is required that the regulating blade be disposed at the side of or below the developing roll. However, when the regulating blade is disposed below the developing roll, it becomes difficult to supply the tonor to the regulating position of the regulating blade on the surface of the developing roll in a stabilized manner.

In order to stably supply the tonor to the vicinity of the regulating blade, it is required to fill up the area in the vicinity of the regulating blade with tonor. However, in a state in which the area in the vicinity of the regulating blade is filled up with tonor, it becomes difficult to allow the surplus tonor subjected to the regulation by the regulating blade to escape and, hence, the tonor tends to produce cake of tonor. When, conversely, it is arranged to make it easier for the tonor subjected to the regulation by the regulating blade to escape, then, since the regulating blade is located below the developing roll, it becomes difficult to stably supply the tonor to the area in the vicinity of the regulating blade and, hence, it becomes difficult for the regulating blade to form a stabilized tonor thin layer.

For these reasons, it is the present state of the art that the one-component developing type, in spite of its being smaller and simpler in structure than the two-component developing device, is only applied to a limited range of photographic printer configurations in which the photosensitive member rotates downward at the tonor transfer point. If a one-component developing device capable of achieving stabilized development also when applied to photographic print systems having a photosensitive member rotating upward at the tonor transfer point can be realized, restrictions on the overall configuration of the device will be reduced and, hence, it will become possible to provide a smaller and more stabilized electrophotographic apparatus.

SUMMARY OF THE INVENTION

It is an object of the present invention to solve the above enumerated problems and provide a one-component developing device which is capable of forming a stabilized tonor layer and in which a developing roll with a tonor thin layer formed thereon is rotated upward at the tonor transfer position facing the photosensitive member.

It is another object of the present invention to provide a smaller and more stabilized electrophotographic apparatus by eliminating restrictions on the configuration of a one-component development system so as to allow the apparatus to be made smaller in size.

In order to attain the above objects, the invention employs a tonor supply chamber for supplying tonor to a developing roll and a tonor recovery chamber for recovering a surplus of tonor regulated by a regulating blade and, further, the tonor supply chamber and the tonor recovery chamber are completely separated from each other by a sheet-shaped member in contact with the developing roll. Further, the tonor supplied to the supply chamber is pressed against the surface of the developing roll by the sheet-shaped member separating the tonor supply chamber and the tonor recovery chamber. Thereby, a relatively thick tonor layer is formed on the surface of the developing roll before a tonor thin layer is formed on the roll by the regulating blade. The relatively thick tonor layer formed on the surface of the developing roll by the sheet-shaped member separating the tonor supply chamber and the tonor recovery chamber is regulated to form a tonor thin layer by the regulating blade provided in the tonor recovery chamber. A surplus of tonor produced after the regulation is recovered via the recovery chamber.

Further, according to the present invention, since there are provided a tonor supply chamber for supplying tonor to the developing roll and a tonor recovery chamber for recovering a surplus of tonor regulated by the regulating blade, and since the tonor supply chamber and the tonor recovery chamber are completely separated from each other by a sheet-shaped member in contact with the developing roll, it becomes possible to increase the tonor packing condition in the tonor supply chamber and to decrease the tonor packing density in the tonor recovery chamber. Thereby, both a stabilized tonor supply to the developing roll and void formation in the tonor in the recovery passage can be secured.

Further, since in the above configuration a relatively thick tonor layer is formed on the surface of the developing roll before the tonor layer is regulated by the regulating blade, a stabilized tonor supply to the regulating blade can be secured even in a configuration having the regulating blade below the developing roll.

Further, since the regulation of the tonor layer by the regulating blade is carried out in the tonor recovery chamber where the tonor packing density is lower, a surplus of tonor after the regulation can be stably recovered.

Further, the invention calls for a supply roller to be provided in the tonor supply chamber so that tonor is supplied in a more stabilized manner to the developing roll, while securing a high tonor packing density on the side of the tonor supply chamber. Further, the invention employs a raking out means provided also on the side of the tonor recovery chamber for raking out tonor in the recovery chamber, thereby securing space for tonor in the recovery chamber.

For the aforesaid reasons, in a one-component developing device for achieving development by rotating a developing roll with a tonor thin layer formed thereon upward at the tonor transfer position facing the photosensitive member, a developing device capable of forming a stabilized tonor layer can be provided. In addition, by employing this developing device, restrictions on the arrangement of a one-component development apparatus which tends to limit the extent to which it can be made smaller in size are eliminated, and, thereby, a smaller and more stabilized electrophotographic apparatus can be provided.

BEST MODE FOR CARRYING OUT THE INVENTION

[Embodiment 1]

An embodiment according to the present invention will be described below with reference to the accompanying drawings.

Figure 1:
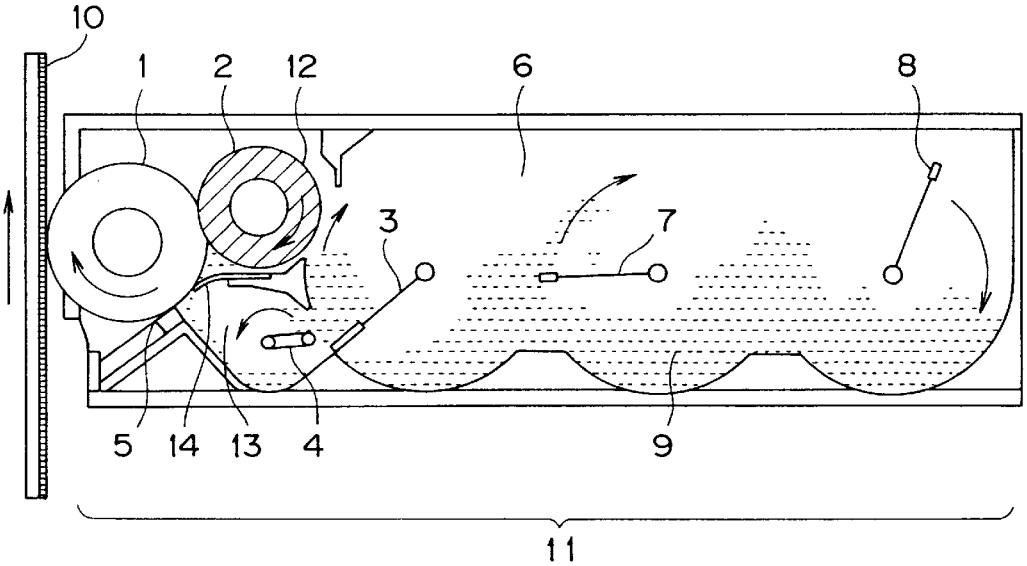
FIG. 1 is a diagram illustrating the configuration of a nonmagnetic one-component developing device representing an embodiment of the present invention.

FIG. 1 is a drawing illustrating the configuration of a nonmagnetic one-component developing device representing an embodiment of the invention. Operations of the developing device shown in FIG. 1 will be described below.

Reference numeral 1 denotes a developing roll for forming an electrically charged tonor thin layer and for transporting the tonor to a photosensitive member; 2 denotes a transport roll for transporting the tonor to the developing roll 1; 3, 7, and 8 denote tonor transporting vanes for agitating the tonor and successively transporting the tonor to the transport roll; 4 denotes a rotating agitator member for agitating recovered tonor; 5 denotes a regulating blade for regulating the amount of the tonor to be attached onto the developing roll 1; 6 denotes a tonor storage for storing the tonor; 9 denotes the tonor; 10 denotes a photosensitive member; 12 denotes a tonor supply chamber for supplying the tonor 9; 13 denotes a tonor recovery chamber for recovering the tonor 9; and 14 denotes a sheet-shaped member disposed in contact with the lower portion of the developing roll 1.

Referring to FIG. 1, the tonor 9 used for development is stored in the tonor storage 6. In order to make the apparatus thin, in the present embodiment, there are disposed three tonor transporting vanes 3, 7, and 8 within the tonor storage 6, so that the tonor is transported by rotation of the vanes in succession to one side of the developing roll. In order that tonor in an amount more than necessary will not unevenly collect on the forward side of the tonor storage 6, it is preferred that the tonor transporting vane 8 on the rearward side of the tonor storage 6 be made smaller in tonor transporting power than the tonor transporting vane 3 on the most forward side. In this embodiment, the rotating speeds of the vanes 7 and 8 are set to be progressively slower than that of the tonor transporting vane 3 on the most forward side according to the position of the vanes in the rearward direction. Further, the vane areas are made progressively smaller according as the vanes are positioned more rearwardly of the tonor transporting vane 3 on the most forward side. The tonor 9 within the tonor storage 6 is transported to the developing roll by rotation of these vanes.

Above the peripheral face of the developing roll, there is formed the tonor supply chamber 12. The tonor 9 transported to the most forward portion of the tonor storage 6 is transported to the tonor supply chamber 12 by the tonor transporting vane 3. Within the tonor supply chamber 12, there is disposed the supply roll 2 formed of a conductive and elastic foam roll, which supplies the tonor 9 in the tonor supply chamber 12 to one side of the developing roll 1 and presses the tonor against the same. In order that the supply of tonor to the developing roll 1 is achieved in a more stabilized manner, it is preferred that the supply roll 2 be disposed to contact the developing roll 1 and be pressed against the same by an amount of several hundred microns to several millimeters.

The tonor 9 supplied to the supply chamber 12 is pressed against the side of the developing roll 1 by rotation of the supply roll 2 and, while being pressed against the developing roll 1 by the sheet-shaped member 14 disposed below the developing roll in the supply chamber, it leaks out to the side of the tonor recovery chamber 13. Since the tonor 9 is electrically charged to a certain degree at this time due to friction with the developing roll 1, the sheet member 14, the supply roll 2, and so forth, it attaches to the surface of the developing roll 1, which is made of a conductive material, to form a tonor layer on the surface of the developing roll 1.

The tonor layer thus formed on the developing roll is regulated by the regulating blade 5 disposed in the tonor recovery chamber 13 to a tonor layer thickness and a tonor electric charge amount suitable for development.

While the ultimate amount of the electric charge and that of the attached tonor of the tonor thin layer necessary for development depend on the conditions of the development to be performed, the apparatus, and the tonor used, it is generally within the range of 0.1–1.5 mg/cm2 for the attached amount and of 5–40 $\mu$C/g for the charged amount. The attached amount of the tonor to be attached to the surface of the developing roll before it goes past the regulating blade must be made sufficiently greater than the ultimate target of the attached amount by means of the sheet-shaped member 14 separating the tonor supply chamber 12 and the tonor recovery chamber 13 from each other. As to the electric charge amount, it should be made smaller than the ultimate target charge amount. In order that a large amount of the tonor is attached onto the developing roll 1 with a relatively small amount of electric charge, it is arranged such that the sheet-shaped member 14 separating the tonor supply chamber 12 from the tonor recovery chamber 13 is held in contact with the developing roll 1 under a lower pressure than that acting on the regulating blade 5 disposed on the downstream side of the developing roll, with the flat face portion (the abdominal portion) of the sheet-shaped member 14 in contact with the developing roll 1.

When the pressure acting on the sheet-shaped member 14 is greater than necessary, the tonor layer formed thereby becomes thinner so that a suitable tonor layer becomes unable to be formed by the regulating blade 5. The suitable value of the contact pressure between the sheet-shaped member 14 and the developing roll 1, though it depends on the supplying ability of the supply roll 2, the fluidity of the used tonor material, and the ultimate target tonor amount, generally is around 0.1–50 g/cm in line pressure. In the developing device of this embodiment, when the ultimate tonor charge amount formed on the developing roll is set at 10–20 $\mu$C/g and the ultimate attached amount is set at 0.4–0.8 mg/cm$^2$, a line pressure of about 30–80 g/cm$^2$ is applied to the regulating blade, while a contact line pressure of about 1–10 g/cm$^2$ is applied to the sheet-shaped member 14. Then, a charge amount of 1–5 $\mu$C/g and a tonor layer with an attached amount of 0.6–1.5 mg/cm$^2$ could be obtained before reaching the regulating blade.

In such a structure that the angled portion (edge portion), not the flat face portion, of the sheet hits the roll, the tonor layer formed thereby was liable to become uneven and the tonor layer finally formed by the regulating blade 5 was liable to become deficient in uniformity. In order to form a stabilized, uniform tonor layer, it is preferred that the sheet-shaped member 14 be put into contact with the developing roll 1 at its flat plane portion.

The tonor 9 left over by the regulation of the regulating blade 5 flows down onto the side of the tonor recovery chamber 13 provided below the tonor supply chamber. In the tonor recovery chamber 13, there is provided the rotating agitator member 4, which agitates the recovered tonor in the recovery passage to prevent the tonor from stagnating or solidifying and also rakes it to be transported to the side of the tonor storage 6. Thereby, there is always left a void in the tonor recovery chamber 13 which allows the tonor left over after the regulation by the regulating blade 5 to flow into the tonor recovery chamber 13 in a stabilized manner.

Figure 2:
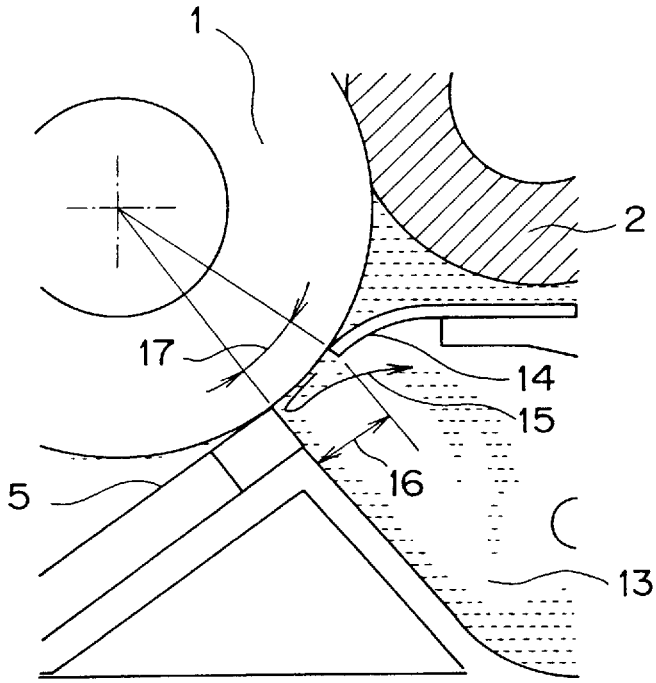
FIG. 2 is a diagram illustrating details of the vicinity of a regulating blade and a sheet-shaped member in the embodiment of FIG. 1.

FIG. 2 is a drawing showing details of the vicinity of the developing roll 1 and the front end of the regulating blade 5 and the vicinity of the contacting point of the sheet-shaped member 14. When the tonor which is transported deposited on the developing roll 1 by the sheet-shaped member 14 is subjected to regulation by the regulating blade 5, the surplus tonor flows in the direction of the arrow 15 in a manner sprung back. At this time, if the distance 16 between the front ends of the sheet-shaped member 14 and the regulating blade 5 is narrow, since the tonor is sprung back toward the front end of the sheet-shaped member 14, such a phenomenon occurs that the tonor does not fall into the tonor recovery chamber 13 but gets solidified between the sheet-shaped member 14 and the regulating blade 5.

In order to prevent this, it is required to provide a suitable gap distance 16 between the sheet-shaped member 14 and the regulating blade 5. In the configuration of the embodiment, a gap distance of about 1 mm or above was empirically necessary though it depends on the fluidity of the tonor, the speed of processing, and the like. When there is a variation in the angle 17 between the contacting points of the regulating blade 5 and the sheet-shaped member 14 with the surface of the developing roll 1, the direction in which the tonor is sprung back by the regulating blade 5 deviates from the direction in which the sheet-shaped member 14 is oriented. It is necessary to set the angle 17 between the contacting points of the regulating blade 5 and the sheet-shaped member 15 with the developing roll 1 at 2–3 degrees or above.

Figure 3:
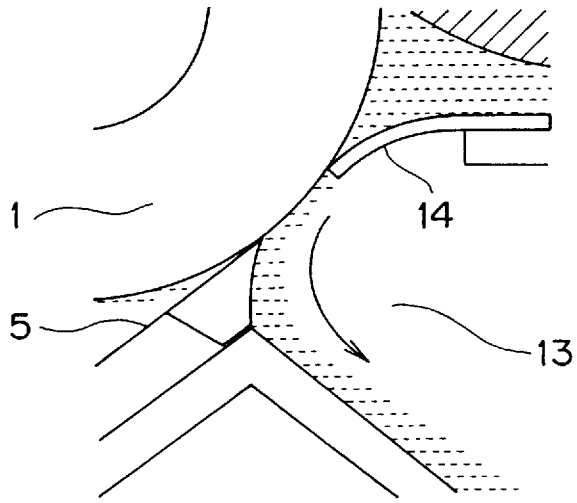
FIG. 3 is a diagram showing another configuration of the regulating blade.

As another method to prevent occurrence of the above phenomenon, such a method can be thought of to form the front end portion of the regulating blade 5 into an acute angled-shape as shown in FIG. 3 or a streamline shape. In order to apply this method, the shape must be carefully examined because the strength of the front end portion of the regulating blade 5 and the fluidity of the tonor affect the press of the blade. Basically, it is necessary to make the gap 16 between the sheet-shaped member 14 and the regulating blade 5 and the angle 17 between the contacting points larger.

Figure 4:
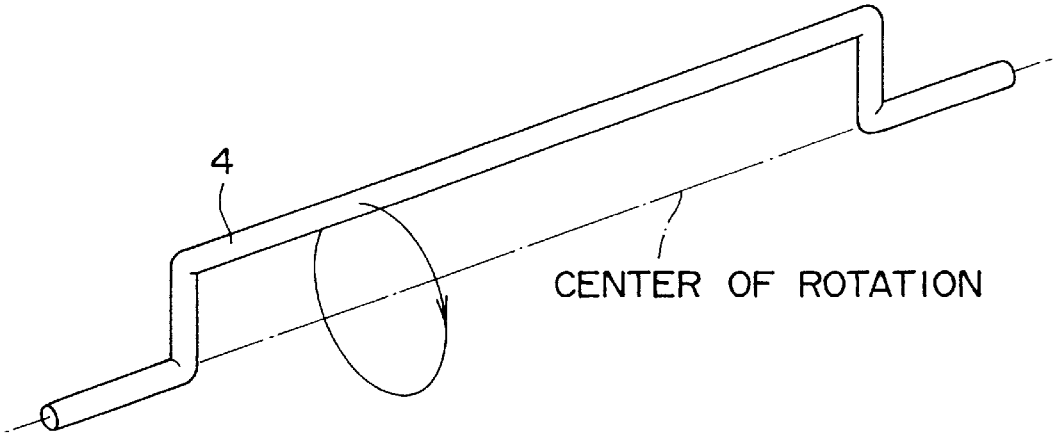
FIG. 4 is a perspective view of a rotating agitator member of the present invention for use in the embodiment of FIG. 1.

FIG. 4 shows a perspective view of the rotating agitator member 4 of the invention in the embodiment of FIG. 1.

The rotating agitator member 4 is of such a configuration that has no shaft in the center of rotation of the agitating portion as shown in FIG. 4. If the rotating agitator member 4 is provided with the rotation center, the tonor attaches to and deposits around the rotation center shaft and such a defect is caused that the tonor develops into a tonor shaft with the same diameter as the outer diameter of the vane. If such a state is brought about, it becomes unable to obtain the agitating function that is the originally expected function of the rotating agitator member 4. Therefore, the rotating agitator member 4 in the present invention is arranged to have no center shaft as shown in FIG. 4. It is preferred that the sectional form of the rotating vane portion be suitably designed according to the fluidity of the tonor, and the like. The tonor in the recovery passage is progressively raked back to the tonor storage 6 by the rotation of the rotating agitator member.

The tonor transporting vane 3 in the tonor storage 6 for transporting the tonor in the tonor storage 6 to the side of the tonor supply chamber 12 also operates to transport and push the tonor into the position of the outlet of the tonor recovery chamber 13. In the developing device of the invention, it is adapted such that the rotating agitator member 4 rakes out the tonor by its rotation to the tonor storage 6 at the timing adjusted to the vane 3 pushing the tonor into the tonor recovery chamber. Therefore, the transportation of the tonor into the recovery chamber 13 by the rotation of the tonor transporting vane 3 in the tonor storage 6 is suppressed and the tonor 9 is prevented from flowing backward into the tonor recovery chamber 13.

In the developing device of the invention of FIG. 1, it is arranged such that the ratio between the rotation diameters of the tonor transporting vane 3 in the tonor storage 6 and the rotating agitator member 4 in the tonor recovery chamber 13 is 3:1 and the ratio between their rotation periods is 1:3. By this arrangement, in the embodiment of the invention, the tonor in the tonor recovery chamber 13 is pushed out by the rotating agitator member 4 at the timing adjusted to the tonor transporting vane 3 in the tonor storage 6 transporting the tonor 9 to the side of the outlet of the tonor recovery chamber 13 and, before the tonor transporting vane 3 pushes in the tonor 9 to the side of the tonor recovery chamber 13 again, the rotating agitator member 4 operates twice to transport the tonor from the tonor recovery chamber 13 to the tonor storage 6. Thus, the tonor can be transported back to the tonor storage 6 more efficiently, while the tonor is prevented from being put into the side of the tonor recovery chamber 13 by the tonor transporting vane 3.

[Embodiment 2]

Now, an embodiment of a color electrophotographic apparatus employing a developing device of the present invention will be shown.

When the nonmagnetic one-component developing device of the invention is applied, the developing device can be disposed on the plane facing the photosensitive member moving upward. Therefore, restrictions on the overall arrangement and configuration of the electrophotographic apparatus are reduced and a more effective configuration of the apparatus can be realized. originally, the nonmagnetic one-component developing device is simpler in structure and can be advantageously made smaller than the two-component developing device.

Figure 5:
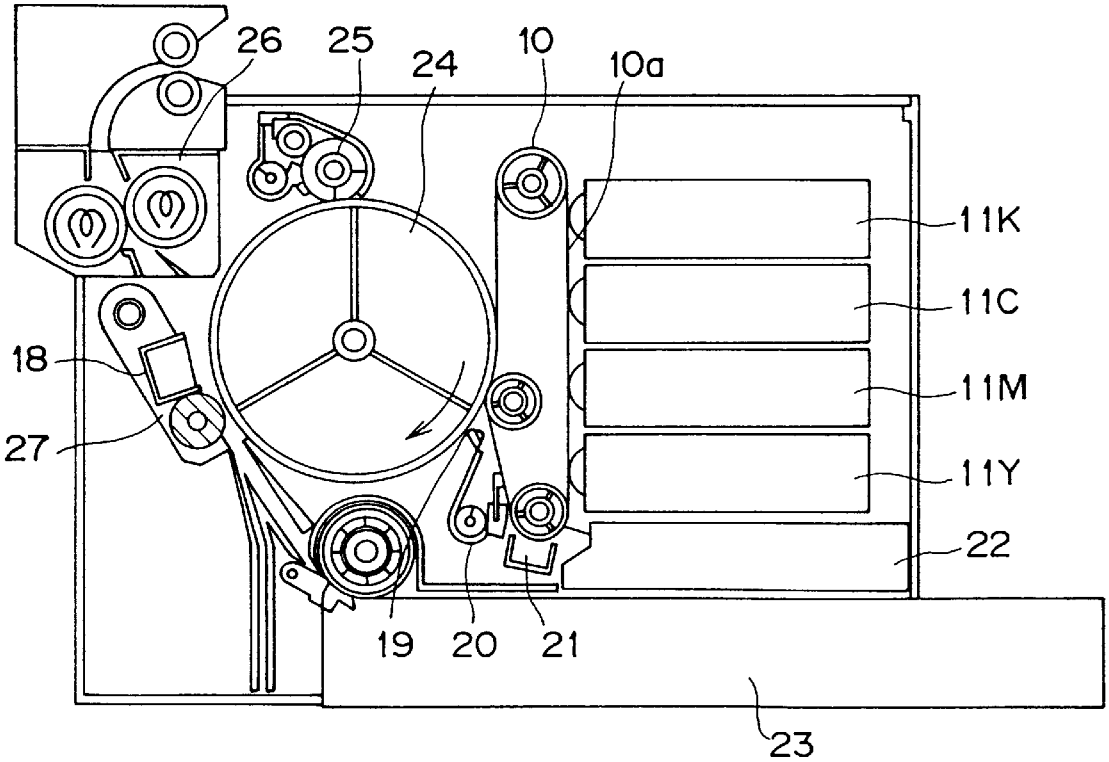
FIG. 5 is a diagram showing an example of a small color electrophotographic apparatus employing the developing device of the present invention.
Figure 6:
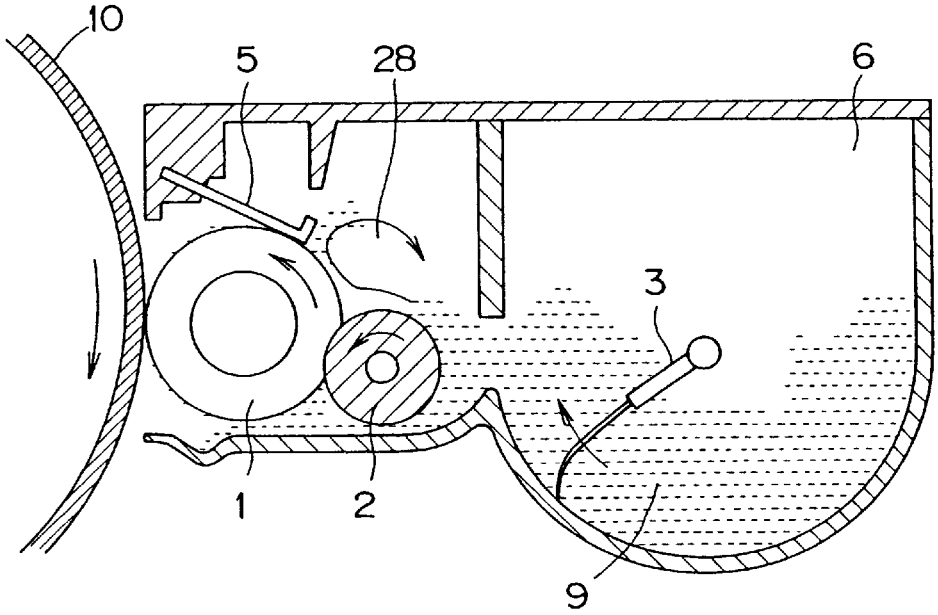
FIG. 6 (PRIOR ART)
FIG. 6 is a diagram showing the configuration of a known nonmagnetic one-component development apparatus.
Figure 7:
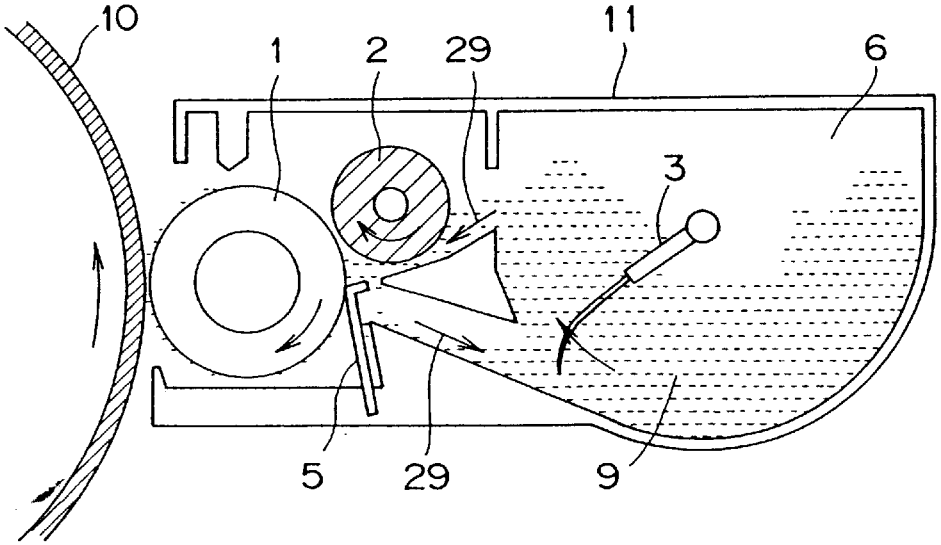
FIG. 7 (PRIOR ART)
FIG. 7 is a diagram showing another configuration of known nonmagnetic one-component development apparatus.

FIG. 5 shows an embodiment of a configuration of a small color electrophotographic apparatus employing a developing device of the invention. Shown in FIG. 5 is a color electrophotographic apparatus of a type employing a photosensitive belt and an intermediate transfer drum 24.

Referring to FIG. 5, reference numeral 10*a* denotes a photosensitive belt, 11Y, 11M, 11C, and 11K respectively denote developing devices for transferring yellow image, magenta image, cyan image, and black image; 18 denotes a charge eliminator for de-charging a sheet of paper onto which an image has been transferred and peeling it off the intermediate transfer drum; 19 denotes an erase lamp for erasing electric charge remaining on the surface of the photosensitive belt; 20 denotes a blade cleaner for removing residual tonor on the surface of the photosensitive belt 10*a*; 21 denotes a charger for uniformly charging the surface of the photosensitive belt; 22 denotes a laser exposing device for exposing the surface of the photosensitive belt 10*a* which is uniformly charged and forming an electrostatic latent image on the surface thereof; 23 denotes a paper cassette for containing sheets of paper; 24 denotes the intermediate transfer drum for completing a plurality of tonor images formed on the photosensitive belt 10*a* and transferring the color tonor image onto a sheet of paper; 25 denotes a cleaner for removing residual tonor on the intermediate transfer drum 24, and 26 denotes a fixing device for allowing the sheet of paper onto which a tonor image has been transferred to pass between a heating roller and a pressure roller so that the tonor image is fixed on the sheet of paper.

A photographic printing process performed in the apparatus of FIG. 5 will be briefly described below. After the photosensitive member 10 is uniformly charged by the charger 21, exposure in accordance with an image signal is made by the laser exposing device 22 so that an electrostatic latent image is formed on the photosensitive member 10. The electrostatic latent image formed on the photosensitive belt 10*a* is developed by the developing device 11Y of the invention containing yellow tonor. The image gone through the development is electrostatically transferred onto the intermediate transfer drum 24. The photosensitive member 10, after the transfer has been made, is irradiated by the erase lamp 19 to have the electrostatic image erased therefrom and, then, cleaned of residual tonor by the blade cleaner 20. The photosensitive belt 10*a* gone through the cleaning is subjected to charging and exposure again so that an electrostatic latent image is formed on the photosensitive belt 10*aa* again. The electrostatic latent image on the photosensitive belt 10*a* is developed by the developing device 11M of the invention containing magenta tonor so that a magenta image is formed on the photosensitive member. The developing devices used for development are switched by being detached from the photosensitive member 10. The magenta image on the photosensitive member is transferred onto the intermediate transfer member 24 superposed on the yellow image. In succession thereto, through the similar process, a cyan and a black image are formed and superposed one after the other on the image on the intermediate transfer drum 24. The four color images superposed one over another on the intermediate transfer drum 24 are simultaneously, electrostatically transferred in a lump 27 onto a sheet of paper transported from the paper cassette 23, whereby a four-color image is formed on the sheet of paper. The intermediate transfer drum 24 from which the image has been transferred to the sheet of paper is cleaned of the residual tonor by the cleaner 25. The sheet of paper with the image transferred onto the same is de-electrified by the de-electrifier 18 and peeled off the intermediate transfer drum 24 and then the image is heated to melt and fixed by the fixing device 26 and thereby a final image is obtained.

The configuration of the apparatus shown in this embodiment, by employing the photosensitive belt 10*a* and disposing the developing devices in tiers on one side thereof, realizes highly packed mounting of components with a simple structure. Further, by employing the intermediate transfer member 24, there are produced no sharply bent portions on the transport passage of a sheet of paper. Hence, recording on a thick sheet of paper is made possible and wide variety of kinds of paper are usable as with a monochromatic electrophotographic apparatus. Further, by employing the intermediate transfer drum for stabilizing the rotating operation of the intermediate transfer member, it is made possible to have images of various colors formed on the photosensitive belt finely registered with each other and to realize a full-color record of high-quality image.

The apparatus shown in this embodiment is an embodiment of a full-color electrophotographic apparatus with merits of being small in size and having highly packed components, recording high-quality image, and having taken into consideration such a convenience in use as applicability to face-down waste paper and various types of paper.

Through application of the developing device of this embodiment, it also becomes possible to realize an apparatus with the most suitable configuration.

What is claimed is:

1. A developing device comprising:

an electrostatic latent image carrying member;

a toner carrying member for transporting toner to the surface or vicinity of said electrostatic image carrying member;

toner layer formation means for forming an electrically charged toner layer on the surface of said toner carrying member and for regulating an amount of toner in said toner layer;

a toner supply chamber for supplying toner to the surface of said toner carrying member; and a toner recovery chamber for recovering a surplus of toner regulated by said toner layer formation means;

wherein said supply chamber and said recovery chamber are separated from each other by a member in contact with said toner carrying member.

2. A developing device according to claim 1, wherein said member in contact with said toner carrying member is a sheet-shaped member.

3. A developing device according to claim 2, wherein said sheet-shaped member is disposed on the upstream side in the rotating direction of said toner carrying member of said toner layer formation means.

4. A developing device according to claim 2, wherein said toner layer formation means is a blade member in contact with the surface of said toner, carrying member, and said sheet-shaped member is in contact with the surface of said toner carrying member under a lower pressure than the contact pressure of said blade-shaped member.

5. A developing device according to claim 1, wherein said toner recovery chamber is provided therein with rotational raking means for agitating recovered toner.

6. A developing device according to claim 1, wherein said toner supply chamber is disposed above said toner recovery chamber.

7. A developing device comprising:

an electrostatic latent image carrying member;

a toner carrying member for transporting toner to the surface or vicinity of said electrostatic image carrying member;

first toner layer formation means for transporting said toner to the surface of said toner carrying member and for regulating toner on the surface of said toner carrying member thereby forming a first toner layer thereon; and second toner layer formation means for regulating toner which has passed through said first toner layer formation means and for forming said first toner layer into a second toner layer thinner than said first toner layer;

wherein said first toner layer formation means is a sheet-shaped member in contact with said toner carrying member.

8. A developing device according to claim 7, wherein said sheet-shaped member is disposed such that a surface portion of said member is in contact with the surface of said toner carrying member.

9. A developing device according to claim 8, wherein said sheet-shaped member is in contact with the surface of said toner carrying member under a pressure lower than 50 g/cm.

10. A developing device according to claim 7, wherein said sheet-shaped member is disposed on the upstream side in the rotating direction of said toner carrying member of said second toner layer formation means disposed on said toner carrying member and that the angle between the contact position of said second toner formation means with said toner carrying member and the contact position of said sheet-shaped member with said toner is set at 2 degrees or above on said toner carrying member.

11. A developing device comprising:

an electrostatic latent image carrying member;

a toner carrying member for transporting toner to the surface or vicinity of said electrostatic image carrying member;

first toner layer formation means for transporting said toner to the surface of said toner carrying member and for regulating toner on the surface of said toner carrying member thereby forming a first toner layer thereon; and second toner layer formation means for regulating toner which has passed through said first toner layer formation means and for forming said first toner layer into a second toner layer thinner than said first toner layer;

wherein said first toner layer formation means is in contact with said toner carrying member under a lower pressure than the contact pressure under which said second toner layer formation means is in contact with said toner carrying member.

12. A developing device according to claim 11, wherein said toner carrying member rotates upward at a toner transfer position thereof facing said electrostatic image carrying member.

13. An electrophotographic apparatus including said developing device set forth in claim 11.

14. An electrophotographic apparatus according to claim 13, wherein said electrostatic latent image carrying member, which is contacted or approached by said toner carrying member of said developing device, is driven upward along the direction of gravity.

15. An electrophotographic apparatus according to claim 13, wherein there are provided therein at least two developing devices and said developing devices are disposed in tiers and that said electrostatic image carrying member, which is contacted or approached by said toner carrying member of said developing device, is a belt-shaped member stretched longitudinally along the direction of gravity.

16. An image forming apparatus according to claim 13, further comprising a plurality of developing devices containing different colors of toner and disposed in tiers on one side of a photosensitive member in belt form and an intermediate transfer member onto which images formed on said photosensitive member by said plurality of developing devices are transferred one after another so that a color image can be formed thereon.

* * * * *